US007334589B2

(12) United States Patent
Jordan et al.

(10) Patent No.: US 7,334,589 B2
(45) Date of Patent: Feb. 26, 2008

(54) SOUND SEALING SYSTEM FOR A DISHWASHER

(75) Inventors: Marty R. Jordan, Huron, TN (US); Randy D. McAlexander, Atwood, TN (US); Mark B. Neff, Medon, TN (US); Barry E. Tuller, Humboldt, TN (US)

(73) Assignee: Whirlpool Corporation, Benton Harbor, MI (US)

( * ) Notice: Subject to any disclaimer, the term of this patent is extended or adjusted under 35 U.S.C. 154(b) by 631 days.

(21) Appl. No.: 10/681,093

(22) Filed: Oct. 9, 2003

(65) Prior Publication Data

US 2005/0076938 A1 Apr. 14, 2005

(51) Int. Cl.
*B08B 3/00* (2006.01)

(52) U.S. Cl. ..... 134/200; 134/114; 134/201

(58) Field of Classification Search ..... 134/56 D, 134/57 D, 58 D, 114, 201, 200; 312/228, 312/296, 297, 298, 300; 49/475.1, 469, 370
See application file for complete search history.

(56) References Cited

U.S. PATENT DOCUMENTS

| | | | | |
|---|---|---|---|---|
| 3,295,541 | A | 1/1967 | Ummel | |
| 3,529,881 | A * | 9/1970 | Kaldenberg | 312/276 |
| 5,515,702 | A | 5/1996 | Park | |
| 5,882,096 | A | 3/1999 | Wilhelmstätter et al. | |
| 5,965,851 | A | 10/1999 | Herreman et al. | |
| 6,006,767 | A | 12/1999 | Hecker et al. | |
| 6,536,451 | B2 | 3/2003 | Hechtl et al. | |
| 6,539,955 | B1 * | 4/2003 | Tilton et al. | 134/58 D |
| 7,041,377 | B2 * | 5/2006 | Miura et al. | 428/442 |
| 2003/0041523 | A1 | 3/2003 | Kiesler et al. | |

FOREIGN PATENT DOCUMENTS

| | | | |
|---|---|---|---|
| DE | 19907144 | A1 * | 8/2000 |
| DE | 19907145 | A1 * | 8/2000 |
| GB | 2130082 | | 5/1984 |
| GB | 2130478 | | 6/1984 |
| GB | 2130479 | | 6/1984 |
| GB | 2201886 | A * | 9/1988 |
| GB | 2215991 | | 10/1989 |

* cited by examiner

*Primary Examiner*—Alexander Markoff
(74) *Attorney, Agent, or Firm*—Michael D. Lafrenz; John Morrison

(57) ABSTRACT

A dishwasher includes a frontal frame, a tub having a plurality of walls collectively define a washing chamber, and a door pivotally mounted to the frontal frame for sealing the washing chamber. During a washing operation, sound generated by operation of a mechanical pump escapes from below the dishwasher. To minimize sound from escaping and to provide a more enjoyable environment, a sound sealing system is mounted at a bottom portion of the dishwasher door. The sound seal system includes a sound tray that extends across the frontal frame below a bottom edge portion of the door. The sound tray can be directly, pivotally attached to the door, or an additional flexible seal is employed to span and seal a gap between the sound tray and the bottom portion of the door.

22 Claims, 4 Drawing Sheets

SOUND SEALING SYSTEM FOR A DISHWASHER

BACKGROUND OF THE INVENTION

1. Field of the Invention

The present invention pertains to the art of dishwashers and, more particularly, to a sealing system for preventing sound from escaping from an area below the dishwasher.

2. Discussion of the Prior Art

A conventional dishwasher will include an integrally molded tub that defines a washing chamber, dish racks for supporting kitchenware, and a door for sealing the washing chamber, as well as various spray arms, pumps and controls for performing selected washing operations. During a typical washing operation, a circulation pump circulates a washing fluid through various conduits into the spray arms that redirect the washing fluid onto the kitchenware. At the completion of the washing operation, the recirculation pump is operated in reverse or, if the dishwasher is so equipped, a dedicated drain pump is activated to withdraw the washing fluid from the washing chamber. The operation of the various pumps, combined with the moving washing fluid, generates a rather substantial amount of noise in the area of the dishwasher. As the kitchen is becoming a focal point of family activity and many kitchens are arranged adjacent to family rooms and other high usage areas of the home, it is desirable to provide kitchen appliances that operate at low sound levels.

In order to reduce the sound emanating from dishwashers, manufacturers wrap the dishwashers in insulation, provide installation kits that include trim pieces for sealing between the dishwasher and adjacent cabinetry, and provide seals about the door to prevent both washing fluid and noise from escaping from the washing chamber. In addition to the above, another zone of concern is the space or zone below the washing chamber. In general, this space is used to mount the various pumps and other noise producing components of the dishwasher. Towards that end, manufacturers provide various trim pieces and noise barriers to cover the area below the dishwasher. Unfortunately, as the door will typically pivot about a lower edge portion, there still exists a gap between the door and the space below the dishwasher from which sound will emanate.

Even though there are several arrangements that provide a seal between the door and the tub, there still exists a need in the art for sealing between the door and the space below the dishwasher. More specifically, there exists a need in the art for a sound sealing system for a dishwasher which mounts externally between the door and the space below the dishwasher. Particularly, a need exists for a seal arrangement designed to minimize manufacturing costs and complexity, while reducing overall noise emissions from the appliance.

SUMMARY OF THE INVENTION

The present invention is directed to a sound sealing system for a dishwasher which preferably includes a frontal frame having two upstanding side portions interconnected with a top member, a tub, and a door. More specifically, the tub is formed from integral bottom, opposing side, rear and top walls that collectively define a washing chamber. The washing chamber is provided with a central, frontal opening into which is placed kitchenware to undergo a washing operation. The door includes a bottom edge portion that is pivotally mounted to the frame to selectively seal the frontal opening of the washing chamber.

In accordance with one preferred embodiment of the present invention, a sound tray is mounted below the bottom edge portion of the door and connected between the upstanding side portions of the frontal frame. The sound tray is spaced from the bottom edge portion to allow the door to pivot between open and closed positions. With this construction, a gap, through which sound may escape, exists between the door and the sound tray. In order to prevent sound from escaping, a flexible seal is secured to one of the door and the sound tray. The seal extends across and closes the gap, while still enabling the door to pivot between the open and closed positions.

In accordance with another embodiment of the present invention, the sound tray is substantially L-shaped, having a first edge portion leading to a horizontal top portion that terminates in a vertical front portion. The vertical front portion extends substantially perpendicular from the top portion. In accordance with one aspect of this preferred embodiment, the flexible seal is secured to the first edge of horizontal top portion of the sound tray. The seal extends from the sound tray, across the gap and seals against the bottom edge portion of the door. In accordance with another aspect of the present invention, the bottom edge portion of the door is provided with a flange or turn-down extension. The flange extends down from the door toward the L-shaped sound tray. With this arrangement, the flexible seal extends from the front edge of the horizontal top portion and lays against the door flange.

In accordance with a further preferred embodiment of the present invention, the sound tray is substantially Z-shaped. The Z-shaped sound tray includes an angled sealing portion that extends from the front edge portion to the horizontal top portion that terminates at the vertical face portion. With this arrangement, the flexible seal is fixedly attached to the bottom edge portion of the door, extends across the gap, and seals against the angled sealing portion of the sound tray.

In an alternative arrangement, the flexible seal includes first and second end portions separated by a flexible intermediate portion. In accordance with this embodiment, the flexible seal is attached to both the sound tray and the bottom edge portion of the door to seal the area below the dishwasher. In still another arrangement, the sound tray is pivotally mounted to a bottom portion of the dishwasher door. When the dishwasher door is opened, an actuating mechanism causes the sound tray to pivot, preventing the sound tray from interfering with operation of the door.

Additional objects, features and advantages of the present invention will become more readily apparent from the following detailed description of preferred embodiments when taken in conjunction with the drawings wherein like reference numerals refer to corresponding parts in the several views.

DETAILED DESCRIPTION OF THE PREFERRED EMBODIMENTS

Figure 1:
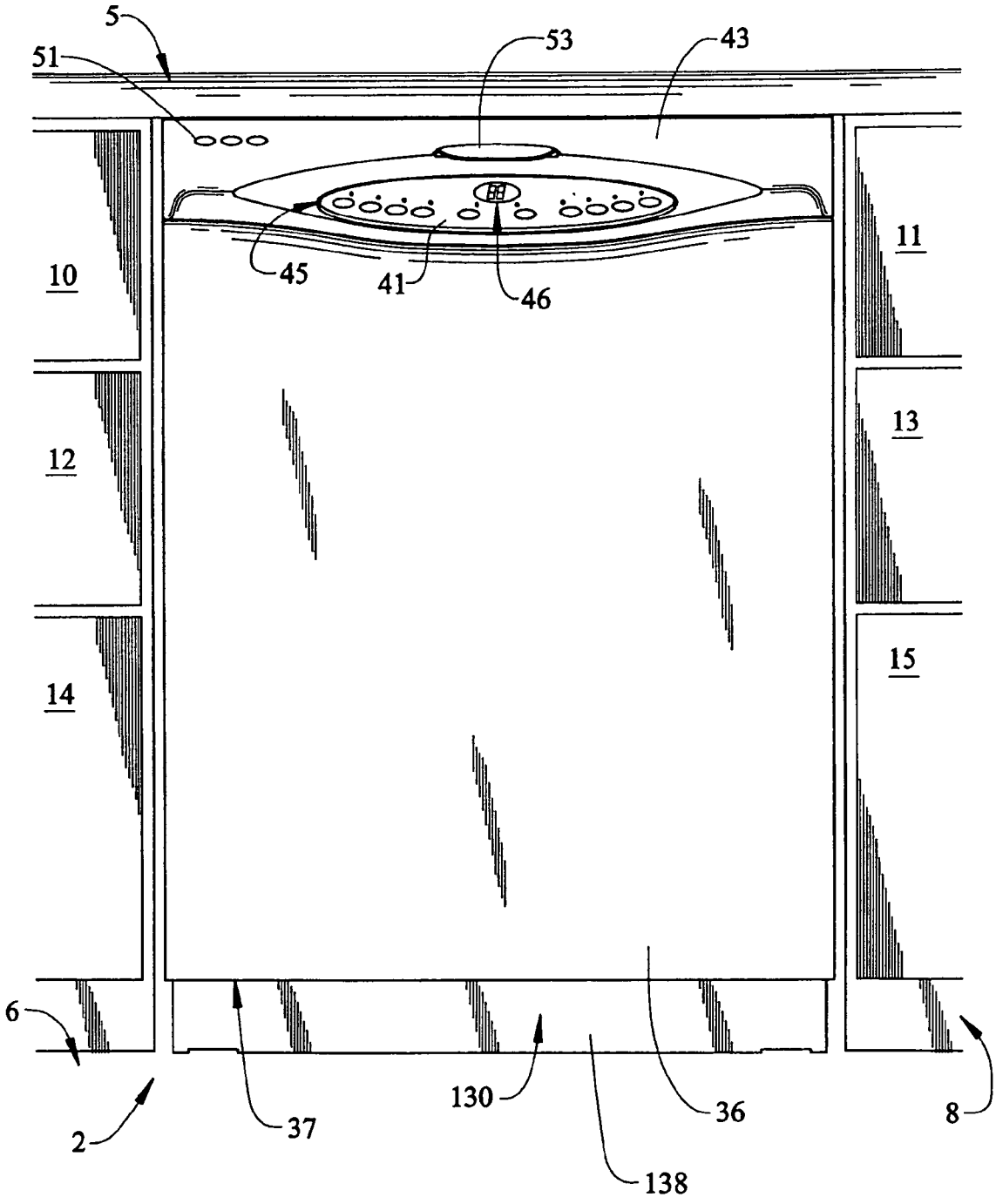
FIG. 1 is a front elevational view of a dishwashing machine incorporating the sound sealing system of the present invention.
Figure 2:
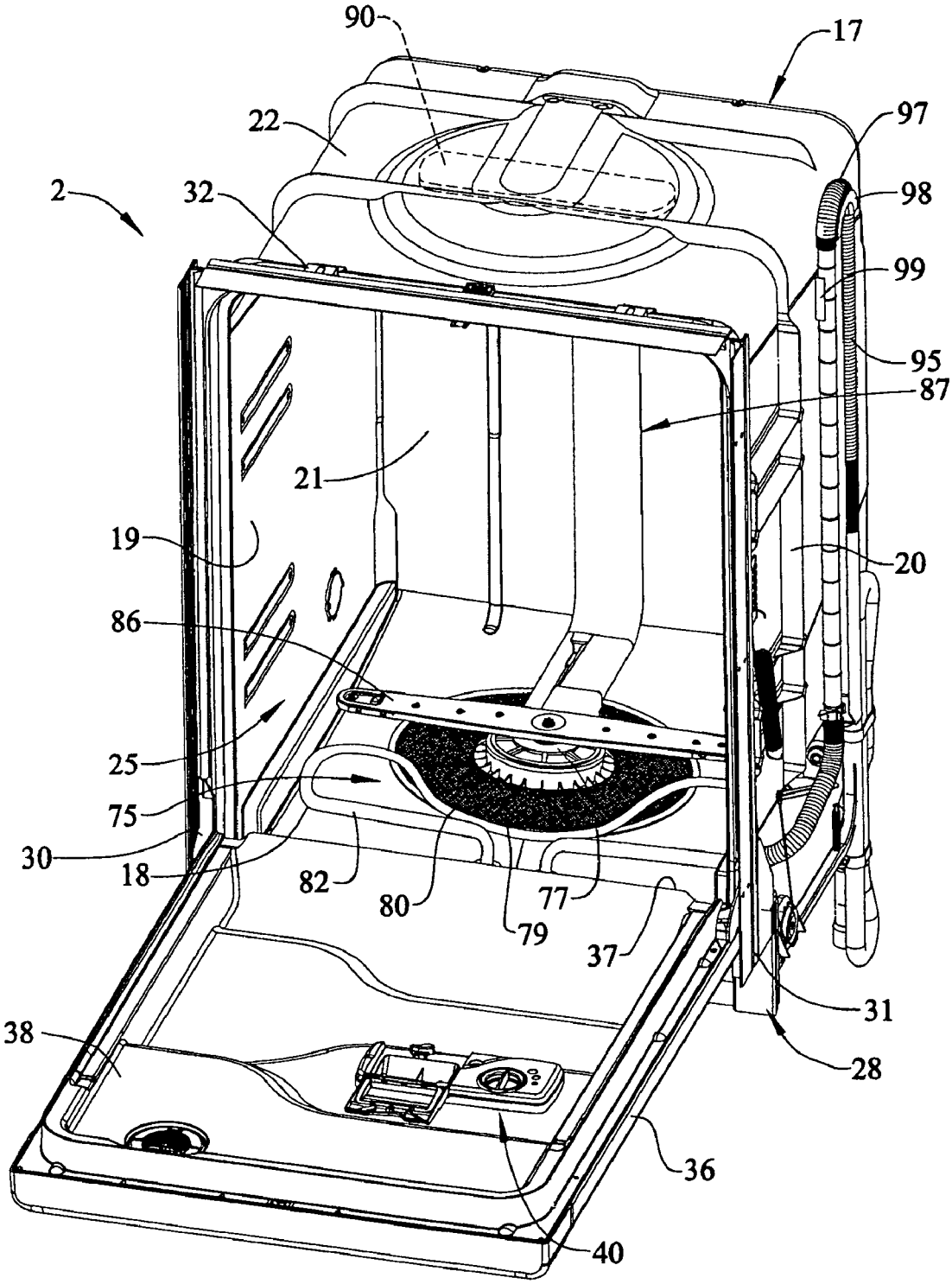
FIG. 2 is an upper right perspective view of the dishwasher of FIG. 1, with a door of the dishwasher being shown open.

With initial reference to FIG. 1, a dishwasher 2 is generally indicated to be positioned below a kitchen countertop 5 and resting upon a supporting surface 6. Also below countertop 5 is cabinetry 8 including a plurality of drawers 10-15. As best shown in FIG. 2, dishwasher 2 includes a tub 17 which is preferably injected molded of plastic so as to include integral bottom, side, rear and top walls 18-22 respectively. Within the confines of walls 18-22, tub 17 defines a washing chamber 25 within which soiled kitchenware and the like is adapted to be placed upon shiftable upper and lower racks (not shown), with the kitchenware being cleaned during a washing operation in a manner widely known in the art.

Tub 17 has attached thereto a frontal frame 28 that provides structural support for dishwasher 2. As shown, frontal frame 28 includes first and second upstanding side portions 30 and 31 interconnected through a top member 32. As also shown, dishwasher 2 is provided with a door 36 pivotally mounted to frontal frame 28 at a bottom portion 37 thereof. With this arrangement, frontal frame 28 is adapted to pivotally support door 36 for selectively sealing washing chamber 25. As also shown in FIG. 2, door 36 is provided with an inner liner 38 having arranged thereon a detergent tray assembly 40 within which a consumer can place liquid or particulate washing detergent for dispensing at predetermined portions of the washing operation. Of course, dispensing detergent in this fashion is known in the art such that this arrangement has only been described for the sake of completeness.

In the embodiment shown, dishwasher 2 is also shown to include a control and display panel portion 41 (see FIG. 1) arranged on an upper portion 43 of door 36. Control and display panel portion 41 includes a row of control buttons 45, each preferably having associated therewith an LED (not separately labeled) for indicating the selection of a particular button. Furthermore, control and display panel portion 41 is provided with a digital display 46 that preferably indicates a time remaining in hours or minutes of a particular washing operation. Arranged above control and display panel portion 41 is a vent zone 51 which allows steam developed during a washing operation to vent to the surroundings, as well as a handle 53 for opening door 36. In general, this overall arrangement of dishwasher 2 and countertop 5 is known in the art wherein dishwasher door 36 is adapted to extend across and seal an access opening associated with washing chamber 25, while also being pivotal, such as through handle 53, to a position which enables loading and unloading of kitchenware as shown in FIG. 2.

As illustrated in FIG. 2, disposed within tub 17 and, more specifically, mounted at bottom wall 18, is a pump assembly 75. Preferably, pump assembly 75 includes a main housing 77, an annular, radial outermost strainer 79 and an annular radial inner or coarse strainer 80. The particular structure and operation of pump assembly 30 is not part of the present invention and is actually set forth in commonly assigned U.S. patent application Ser. No. 10/186,739 entitled "Dishwasher Pump and Filtration System" filed on Jul. 2, 2002 and incorporated herein by reference. A heating element 82 is shown extending about a frontal portion of pump assembly 75 at a position raised above bottom wall 18. Heating element 82 preferably takes the form of a sheathed electric resistance-type heating element.

In general, pump assembly 75 is adapted to direct washing fluid to at least a lower wash arm 86 and a conduit 87. As depicted, conduit 87 actually extends along rear wall 21 and thereafter along top wall 22. With this arrangement, conduit 87 actually rotatably supports an upper wash arm 90 which is used for spraying a washing fluid down onto kitchenware placed in washing chamber 25. In addition, pump assembly 75 has associated therewith a drain pump (not shown) supported, at least in part, by bottom wall 18 of tub 17. Actually, a recirculation pump (also not shown) is also positioned under bottom wall 18 of tub 17 to recirculate the washing fluid about washing chamber 25. In any event, the drain pump has associated therewith a drain hose 95 including at least one corrugated or otherwise flexible curved portion 97 that extends about an arcuate hanger 98 provided on an outside surface of side wall 20. Drain hose 95 is also preferably secured to tub 17 through various clips, such as that indicated at 99 in FIG. 2. In any event, in this manner, an upper loop is maintained in drain hose 95 to assure proper drainage in a manner known in the art.

In general, this structure described above with respect to dishwasher 2 does not constitute part of the present invention. Therefore, this structure has only been described for the sake of completeness. Instead, the present invention is particularly directed to a sound sealing system which eliminates, or least significantly reduces, the amount of noise which emanates from below bottom wall 18 of tub 17 due to the operation of the various pumps, i.e. the recirculation and drain pumps, as well as food chopping structure typically employed on a domestic dishwasher.

With initial reference to FIG. 3, a sound sealing system 120 constructed in accordance with a first embodiment of the present invention is shown to include a frontal plate or sound tray 130 (also see FIG. 1) which is positioned below door 36 of dishwasher 2. More specifically, sound tray 130 extends across upstanding side portions 30 and 31 of frontal frame 28. While not shown, a kickplate can be secured to sound tray 130, such as through the use of "VELCRO" or mechanical fasteners, to contribute to an overall aesthetic appearance of dishwasher 2. In any event, sound tray 130, in accordance with the embodiment illustrated in FIG. 3, has a generally Z-shaped cross-section. More specifically, sound tray 130 includes a first edge portion 135 that extends along an angled sealing portion 136. Angled sealing portion 136 leads to a horizontally extending top portion 137 that terminates in a vertical face portion 138. Actually, vertical face portion 138 projects substantially perpendicularly downward from horizontally extending top surface 137 and terminates just above supporting surface 6. First edge portion 135 of sound tray 130 is spaced from bottom edge 37 of door 36 so as to form a gap 140.

In order to prevent, or at least significantly limit, sound emanating through gap 140, a flexible sealing member 145 extends across and effectively closes gap 140. That is, the combination of sound tray 130 and flexible sealing member 145 effectively covers a region below dishwasher door 36 and supporting surface 6. In any event, in the preferred embodiment illustrated in FIG. 3, flexible sealing member 145 includes a first end 146 which is fixedly secured to bottom portion 37 of door 36. Preferably, first end portion 146 leads to a second end portion 148 through an intermediate portion 149. More specifically, second end portion 148, together with a section of intermediate portion 149, actually overlaps onto angled sealing portion 136 with intermediate portion 149 extending across gap 140. With this particular construction, flexible seal 145 closes off gap 140, while being substantially hidden from view so as not to detract from the overall aesthetics of dishwasher 2.

Figure 4:
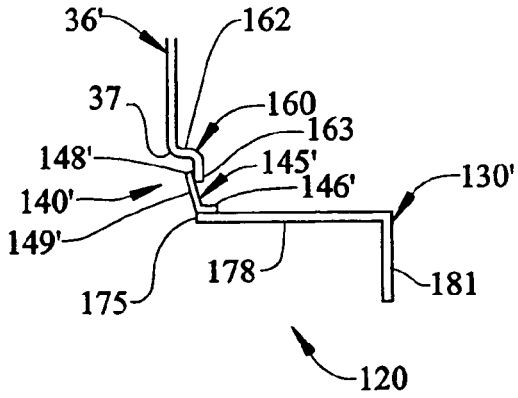
FIG. 4 is a right side elevational view of a bottom portion of a dishwasher, similar to that of FIG. 1, illustrating the sound sealing system constructed in accordance with a second embodiment of the present invention.

In accordance with another preferred embodiment as illustrated in FIG. 4, a door 36' is shown to include a terminal flange portion 160 extending from bottom portion 37. In accordance with the embodiment shown, terminal flange portion 160 has a first end 162 that projects substantially perpendicularly from bottom portion 37 and leads to a second, down turned end 163 that extends substantially parallel to door 36'. In further accordance with the embodiment shown, a sound tray 130' is included that has a generally L-shaped cross-section including a front edge portion 175 extending to a horizontally extending top portion 178 before terminating in a down-turned vertical portion 181. As shown, vertical portion 181 actually projects substantially perpendicularly downward from horizontally extending top surface 178 towards supporting surface 6. A flexible seal member 145' includes a first end portion 146' which is fixedly secured to front edge portion 175 of sound tray 130'. First end portion 146', in a manner generally analogous to that previously described, leads to a second end portion 148' through an intermediate portion 149'. Second end portion 148' together with a section of intermediate portion 149', actually overlap onto down turned end 163 of door 36' with intermediate portion 149' extending across a gap 140'.

Figure 3:
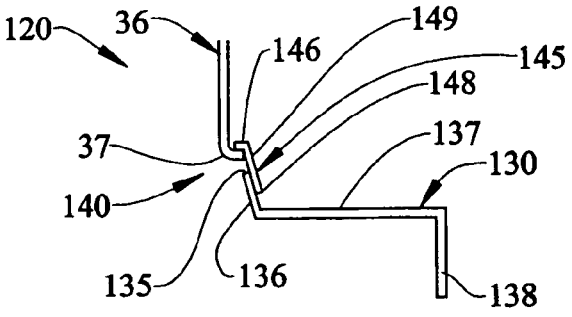
FIG. 3 is a right side elevational view of a bottom portion of the dishwasher of FIG. 1, illustrating the sound sealing system constructed in accordance with one embodiment of the present invention.
Figure 5:
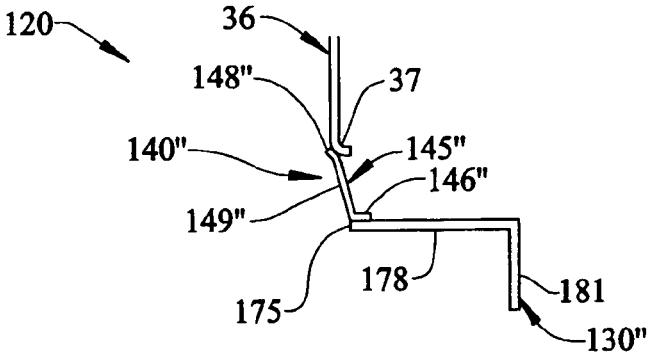
FIG. 5 is a right side elevational view of a bottom portion of a dishwasher, similar to that of FIG. 1, illustrating the sound sealing system constructed in accordance with a third embodiment of the present invention.

Referring to FIG. 5 which illustrates another embodiment of the present invention, a sound tray 130" is positioned in a manner similar to that illustrated in FIG. 3. In accordance with this particular embodiment, a sealing member 145" includes a first end 146" that is fixedly secured to first end portion 175 of sound tray 130". First end portion 146" leads to second end portion 148" through an extended intermediate portion 149". In this manner, intermediate portion 149" extends across a wider gap 140" resulting from the absence of angled sealing portion 136. In any event, sound generated by the mechanical components operated during the washing operation is substantially prevented from escaping to the surroundings while, at the same time, door 36 is allowed to freely pivot between open and closed positions.

Figure 6:
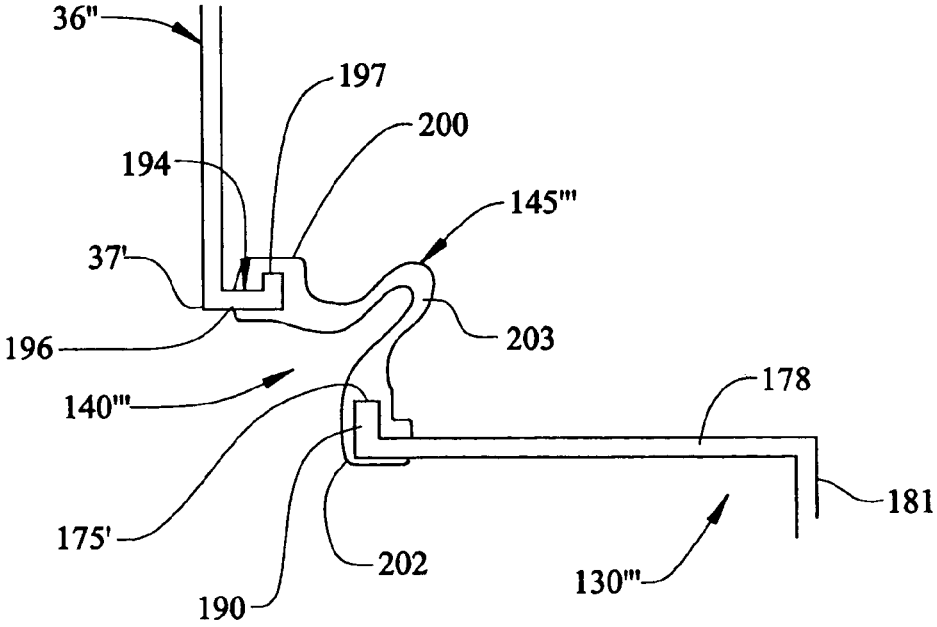
FIG. 6 is a right side elevational view of a bottom portion of a dishwasher, similar to that of FIG. 1, illustrating the sound sealing system constructed in accordance with a fourth embodiment of the present invention.

Referring to FIG. 6 which illustrates a further embodiment of the present invention, a flexible seal member 145'" extends across a gap 140'" and actually interconnects with door 36" and a sound tray 130'". As shown, in order to provide an advantageous mounting for flexible seal member 145'", sound tray 130'" is provided with an upturned tab portion 190 at a first edge portion 175'. Preferably, tab portion 190 projects substantially perpendicularly upward from horizontally extending top surface 178. Using a similar arrangement, a door 36" is formed with a bottom portion 37' that is provided with an in-turned flange member 194. In-turned flange member 194 includes a first section 196 that extends substantially perpendicularly inward from door 36" leading to a upwardly projecting tab end portion 197.

In order to accommodate tab portions 190 and 197, flexible seal member 145'" includes a first terminal connecting portion 200 that is adapted to slip onto tab member 197 thus forming a resilient connection. First terminal connecting portion 200 extends to a second terminal connecting portion 202 adapted to slip onto tab portion 190 of sound tray 130'". Extending between first and second terminal connecting portions 200 and 202 and across a gap 140'" is a flexible, intermediate section 203 adapted to flex as door 36 moves between open and closed positions while, at the same time, limiting the level of sound that can escape from the area below dishwasher 2.

Figure 7:
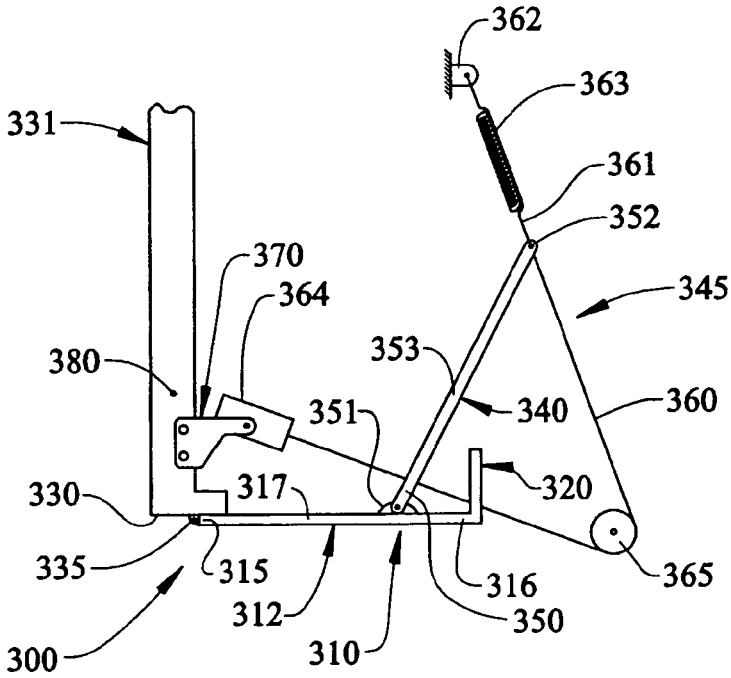
FIG. 7 is a right side elevational view of a bottom portion of a dishwasher, similar to that of FIG. 1, illustrating the sound sealing system constructed in accordance with a fifth embodiment of the present invention.
Figure 8:
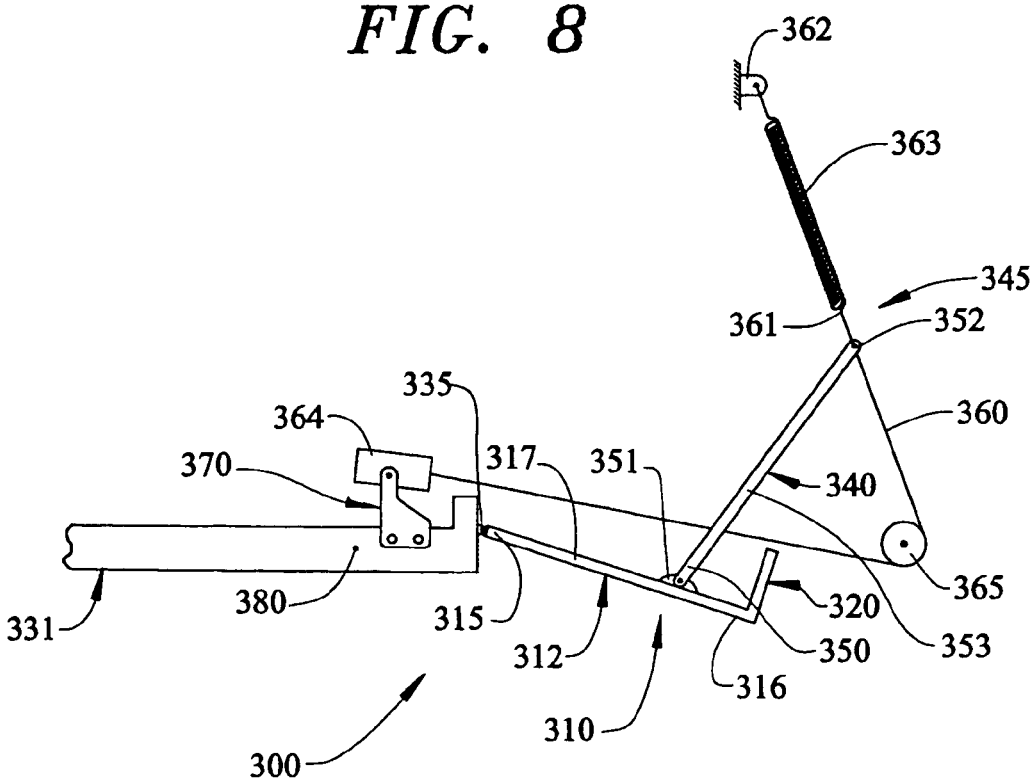
FIG. 8 is a right side elevational view of a bottom portion of a dishwasher, similar to that of FIG. 2, illustrating the sound sealing system constructed in accordance with the fifth embodiment shown in a pivoted or open position.

FIGS. 7 and 8 illustrate a sound sealing system 300 constructed in accordance with still another embodiment of the present invention. As shown, sound sealing system 300 includes a sound tray 310 having an L-shaped cross-section. Sound tray 310 includes a first leg member 312 having a first end 315 leading to a second end 316 through an intermediate portion 317. A second leg member 320 extends upward, substantially perpendicular to second end 316 of first leg member 312. In accordance with the embodiment shown, first end 315 is pivotally mounted to a bottom portion 330 of a dishwasher door 331. That is, a hinge unit 335 interconnects sound tray 310 with door 331 which, as will discussed more fully below, enables sound sealing system 300 to pivot relative to door 331 when dishwasher 2 is opened.

Sound tray 310 is also interconnected to an actuating rod 340 which interconnects intermediate portion 317 with a dishwasher door control mechanism 345 (also shown, but not labeled, in FIG. 2). More specifically, actuating rod 340 includes a first end 350 which is pivotally secured to sound tray 310 through a pivot member 351 and leads to a second end 352 through an intermediate portion 353. Second end 352 is secured to a cable 360 of control mechanism 345. Cable 360 includes a first end 361 which is attached to a stationary member, indicated generally at 362, on a side portion of tub 17 through a spring 363. First end 361 leads to an end mount 364 through a pulley or sheeve member 365. End mount 364 of cable 360 interconnects to door 331 through a bracket member 370 fixed to door 331.

With this particular arrangement, as door 331 pivots about a substantially horizontal pivot axis indicated at 380, bracket member 370 draws cable 360 about pulley 365, thereby placing cable 360 in tension through spring 363 in order to prevent door 331 from falling sharply to an open position, as well as aiding in the closing of door 331. As door 331 is shifted from the closed position of FIG. 7 to the open position of FIG. 8, cable 360 draws first end 352 of actuating bar 340 downward and rearward. This movement of actuating bar 340 causes sound tray 310 to pivot about hinge member 335, thereby causing second end 316 of sound tray 310 to shift downward. Translation of sound tray 310 enables door 331 to open fully without being obstructed by sound sealing system 300.

As it has been found that sound produced by mechanical components of dishwasher 2, as well as water flowing about tub 17, tends to become focused in a gap region directly below the dishwasher door, providing a seal arrangement which closes off that region in accordance with the invention can advantageously lower the overall sound emanating from a dishwasher. With the sound sealing system of the invention, this gap region is closed off or sealed, thereby establishing a more quite environment during operation of dishwasher 2.

Although described with reference to preferred embodiments of the present invention, it should be readily apparent to one of ordinary skill in the art that various changes and/or modifications can be made to the invention without departing from the spirit thereof. For instance, the various cross-sections described for the sound tray of the invention are for exemplary purposes only, as other geometries that would interface with various dishwasher models could be employed. In general, the invention is only intended to be limited to the scope of the following claims.

We claim:

1. A dishwasher comprising:

a frontal frame adapted to be positioned upon a supporting surface;

a tub including bottom, opposing side, rear and top walls that collectively define a washing chamber, the tub also including a front opening leading into the washing chamber, while being supported by the frontal frame;

a door having a bottom portion, the door being pivotally mounted relative to the frontal frame for selectively sealing the front opening of the tub; and a sound tray extending across the frontal frame below the bottom portion of the door, the sound tray having a first edge portion pivotally mounted to the bottom portion of the door such that the sound tray pivots relative to the door when the door is opened.

2. The dishwasher according to claim 1, further comprising a hinge unit interconnecting the sound tray with the door.

3. The dishwasher according to claim 1, wherein the sound tray is substantially L-shaped in cross-section.

4. The dishwasher according to claim 3, wherein the sound tray includes a horizontally extending portion leading from the first edge portion to a vertical portion extending substantially perpendicularly from the horizontally extending portion.

5. The dishwasher according to claim 1, further comprising a control mechanism interconnected to the door, and an actuating member interconnected between the sound tray and the control mechanism.

6. The dishwasher according to claim 5, wherein the control mechanism includes a cable, the actuating member having a first end pivotally attached to the sound tray and a second end attached to the cable.

7. The dishwasher according to claim 6, wherein the cable has a first end attached through a spring to the side wall of the tub and a second end attached to the door.

8. The dishwasher according to claim 7, further comprising a pulley located intermediate the first and second ends of the cable.

9. The dishwasher according to claim 8, wherein opening the door pulls the cable over the pulley.

10. The dishwasher according to claim 9, wherein pulling the cable over the pulley causes the actuating member to move the sound tray downward.

11. A dishwasher comprising:

a frontal frame adapted to be positioned upon a supporting surface;

a tub including bottom, opposing side, rear and top walls that collectively define a washing chamber, the tub also including a front opening leading into the washing chamber being supported by the frontal frame;

a door having a bottom portion, the door being pivotally mounted relative to the tub for selectively sealing the front opening of the tub; and a sound tray extending substantially horizontally from below the bottom portion of the door and across the frontal frame, the sound tray having a first edge portion pivotally mounted to the bottom portion of the door such that the sound tray pivots relative to the door when the door is opened.

12. The dishwasher according to claim 11, further comprising a hinge unit interconnecting the sound tray with the door.

13. The dishwasher according to claim 11, wherein the sound tray is substantially L-shaped in cross-section.

14. The dishwasher according to claim 13, wherein the sound tray includes a horizontally extending portion leading from the first edge portion to a vertical portion extending substantially perpendicularly from the horizontally extending portion.

15. The dishwasher according to claim 11, further comprising a control mechanism interconnected to the door, and an actuating member interconnected between the sound tray and the control mechanism.

16. The dishwasher according to claim 15, wherein the control mechanism includes a cable, the actuating member having a first end pivotally attached to the sound tray and a second end attached to the cable.

17. The dishwasher according to claim 16, wherein the cable has a first end attached through a spring to the side wall of the tub and a second end attached to the door.

18. The dishwasher according to claim 17, further comprising a pulley located intermediate the first and second ends of the cable.

19. The dishwasher according to claim 18, wherein opening the door pulls the cable over the pulley.

20. The dishwasher according to claim 19, wherein pulling the cable over the pulley causes the actuating member to move the sound tray downward.

21. A dishwasher comprising:

a frontal frame adapted to be positioned upon a supporting surface;

a tub including bottom, opposing side, rear and top walls that collectively define a washing chamber, the tub also including a front opening leading into the washing chamber, while being supported by the frontal frame;

a door having a bottom portion, the door being pivotally mounted relative to the frontal frame for selectively sealing the front opening of the tub; and a sound tray extending rearwardly from the bottom portion of the door and between a first upstanding side portion and a second upstanding side portion of the frontal frame, the sound tray having a first edge portion pivotally mounted to the bottom portion of the door such that the sound tray pivots relative to the door when the door is opened.

22. The dishwasher according to claim 21, further comprising a control mechanism interconnected to the door, and an actuating member interconnected between the sound tray and the control mechanism.

* * * * *